US011512716B2

(12) United States Patent
Gerngross et al.

(10) Patent No.: US 11,512,716 B2
(45) Date of Patent: Nov. 29, 2022

(54) HYDRAULIC AXIS WITH ENERGY STORAGE FEATURE

(71) Applicant: Robert Bosch GmbH, Stuttgart (DE)

(72) Inventors: Royce Gerngross, Houston, TX (US); Reiner Knoell, Burgsinn (DE); Oliver Gerhard, Zellingen (DE); Jim Edward Diehl, Lehighton, PA (US)

(73) Assignees: Bosch Rexroth Corporation, Broadview, IL (US); Robert Bosch GmbH, Stuttgart (DE)

( * ) Notice: Subject to any disclaimer, the term of this patent is extended or adjusted under 35 U.S.C. 154(b) by 250 days.

(21) Appl. No.: 16/778,296

(22) Filed: Jan. 31, 2020

(65) Prior Publication Data

US 2021/0239136 A1 Aug. 5, 2021

(51) Int. Cl.
*F15B 21/14* (2006.01)
*F15B 1/02* (2006.01)
(Continued)

(52) U.S. Cl.
CPC ..... *F15B 1/024* (2013.01); *F15B 1/033* (2013.01); *F15B 7/001* (2013.01); *F15B 7/006* (2013.01);
(Continued)

(58) Field of Classification Search
CPC .. F15B 2211/20561; F15B 2211/20576; F15B 2211/27; F15B 2211/613;
(Continued)

(56) References Cited

U.S. PATENT DOCUMENTS 5,568,766 A * 10/1996 Otremba ..... B30B 15/161 100/258 R
6,962,050 B2 * 11/2005 Hiraki ..... F15B 7/006 60/414
(Continued)

FOREIGN PATENT DOCUMENTS

DE 3272511 * 7/2016 ..... B30B 15/161
DE 102018222425 * 12/2018 ..... B30B 15/161
(Continued)

OTHER PUBLICATIONS

Dietrich, Aaron "Electric rod actuators vs. hydraulic cylinders: A comparison of the pros and cons of each technology", Tolomatic, 2016, pp. 1-13.

*Primary Examiner* — Dustin T Nguyen
(74) *Attorney, Agent, or Firm* — Kelly McGlashen

(57) ABSTRACT

A closed-circuit, self-contained hydraulic axis includes an electric motor, a hydraulic cylinder configured to be connected to a load and a main pump driven by the electric motor to pump hydraulic fluid through the circuit. Pressure connections of the pump are connected to the respective chambers of the cylinder such that the cylinder rod is configured to extend and retract depending on a direction of flow of the hydraulic fluid through the main pump. The hydraulic axis includes a main accumulator connected to the pump via first control valve, an energy storage accumulator connected to the pump via a second control valve, and a charge pump. The hydraulic axis is switchable between a
(Continued)

first operating mode that is free of energy storage in the energy storage accumulator, and a second operating mode in which energy is stored in the energy storage accumulator.

22 Claims, 1 Drawing Sheet

(51) Int. Cl.
*F15B 7/00* (2006.01)
*F15B 1/033* (2006.01)
*B30B 15/16* (2006.01)

(52) U.S. Cl.
CPC ..... *F15B 21/14* (2013.01); *B30B 15/16* (2013.01); *F15B 2211/20515* (2013.01); *F15B 2211/20538* (2013.01); *F15B 2211/20561* (2013.01); *F15B 2211/20576* (2013.01); *F15B 2211/212* (2013.01); *F15B 2211/27* (2013.01); *F15B 2211/613* (2013.01); *F15B 2211/625* (2013.01); *F15B 2211/7053* (2013.01); *F15B 2211/785* (2013.01)

(58) Field of Classification Search
CPC ..... F15B 2211/785; F15B 21/14; F15B 2211/20515; F15B 2211/20538; F15B 2211/212; F15B 2211/625; F15B 2211/7053; F15B 2211/6651; F15B 2211/6658; F15B 2211/88; F15B 1/024; F15B 1/033; B30B 15/16; B30B 15/161; B30B 15/163
See application file for complete search history.

(56) References Cited

U.S. PATENT DOCUMENTS

| | | | | |
|---|---|---|---|---|
| 7,051,526 | B2 | 5/2006 | Geiger | |
| 7,249,458 | B2 | 7/2007 | Arbel et al. | |
| 7,325,398 | B2 * | 2/2008 | Cherney | E02F 9/2217 60/414 |
| 8,033,107 | B2 | 10/2011 | Tikkanen | |
| 8,079,436 | B2 * | 12/2011 | Tikkanen | B60K 17/10 180/165 |
| 8,720,197 | B2 | 5/2014 | Persson et al. | |
| 9,239,064 | B2 * | 1/2016 | Helbig | F15B 1/022 |
| 9,611,619 | B1 * | 4/2017 | Zimmerman | F15B 1/027 |
| 9,719,587 | B2 * | 8/2017 | Schmidt | F15B 11/024 |
| 9,850,916 | B2 * | 12/2017 | Helbig | F03D 7/0224 |
| 9,903,394 | B2 * | 2/2018 | Brahmer | F15B 13/042 |
| 10,202,741 | B2 * | 2/2019 | Kang | F15B 7/003 |
| 10,400,802 | B2 * | 9/2019 | Sugano | E02F 9/2217 |
| 11,255,429 | B2 * | 2/2022 | Giorgio Bort | B60K 6/12 |
| 2013/0133318 | A1 * | 5/2013 | Vogl | B60K 6/12 60/459 |
| 2019/0270369 | A1 * | 9/2019 | Giorgio Bort | F16H 61/4078 |
| 2019/0376535 | A1 * | 12/2019 | Mitsui | F16H 61/4104 |
| 2021/0332831 | A1 * | 10/2021 | Dany | F15B 7/006 |
| 2021/0363729 | A1 * | 11/2021 | Pause | E02F 9/2217 |

FOREIGN PATENT DOCUMENTS

| | | |
|---|---|---|
| DE | 102018201181 | 7/2019 |
| WO | 2012062416 | 5/2012 |
| WO | 2013112109 | 8/2013 |

* cited by examiner

HYDRAULIC AXIS WITH ENERGY STORAGE FEATURE

BACKGROUND

A hydraulic axis is a hydraulic device that includes an actuator in the form of a hydraulic cylinder, and a hydraulic or electro-hydraulic control arrangement or circuit that actuates the actuator with hydraulic fluid. Such hydraulic axes are compact, powerful drives, and are ideally suited for applying large forces and energies over long periods of time or in applications where space is limited. A hydraulic axis can be used in a variety of industrial automation applications, for example in presses, plastic machinery, bending machines, etc. In many applications, a hydraulic axis is designed to realize at least two movements, namely a quick transfer movement as well as a force-applying work movement.

SUMMARY

In some hydraulic axis applications, the hydraulic axis is required to provide high energy to a load only during extension of the actuator, and provide low energy to the load during retraction of the actuator. In one example application, the load is a secondary linear pump which fills during retraction of the actuator and puts energy into the fluid during extension of the actuator. In order to reduce power peaks during load cycles, techniques are often employed to store energy during the reduced load parts of the cycle. This stored energy can then supplement the prime mover of the actuator during high power demands, in a manner analogous to the way in which a battery stores power in a hybrid vehicle.

To achieve this hydraulically, a closed circuit (e.g., a vent and reservoir free circuit) hydraulic axis is provided that includes a prime mover that controls the speed and force applied to the load via an oil filled hydraulic gear system employing a mechanical advantage and rotary to linear motion conversion. More specifically, the hydraulic axis includes an electric motor that drives a bidirectional hydraulic main pump, a differential area, single rod actuator that receives hydraulic fluid from the main pump via a hydraulic circuit, where the ports of the main pump are connected respectively via lines to chambers of the actuator such that the rod is configured to extend and retract depending on a direction of flow of the hydraulic fluid through the main pump. The hydraulic axis includes a main accumulator connected to the circuit via a first control valve and an energy storage accumulator connected to the circuit via a second control valve.

The hydraulic axis can be employed in a first operating mode in which the hydraulic axis is operated conventionally, and the energy storage accumulator is isolated, and in a second operating mode in which the hydraulic axis is operated in an energy storage mode in which the main accumulator is isolated and the energy storage accumulator is activated. The hydraulic axis can be switched between modes during operation, permitting energy storage to be provided as appropriate.

The amount of energy stored in the energy storage accumulator can be varied during each actuator cycle using a variable charge pump to store hydraulic fluid in the energy storage accumulator.

The energy storage feature can be disabled when there is no load in either direction. With the first and second control valves de-energized, the hydraulic axis will not store energy.

In some aspects, a closed hydraulic circuit includes a hydraulic axis. The hydraulic axis includes an electric motor, and an actuator. The actuator includes a cylinder, a piston disposed in the cylinder that segregates an interior space of the cylinder into two chambers, and a rod having a first end that is connected to the piston, and a second end that is configured to be connected to a load. The hydraulic axis includes a bidirectional hydraulic main pump driven by the electric motor to pump hydraulic fluid through the hydraulic circuit. Pressure connections of the main pump are connected via a first line and a second line to the respective chambers of the actuator such that the rod is configured to extend and retract depending on a direction of flow of the hydraulic fluid through the main pump. The hydraulic axis includes a main accumulator connected to the first line via a third line, and a first control valve disposed in the third line between the first line and the main accumulator. In addition, the hydraulic axis includes an energy storage accumulator connected to the first line via a fourth line, and a second control valve disposed in the fourth line between the first line and the energy storage accumulator. The hydraulic axis is switchable between a first operating mode that is free of energy storage in the energy storage accumulator, and a second operating mode in which energy is stored in the energy storage accumulator.

In some embodiments, the hydraulic axis is switched between the first operating mode and the second operating mode by controlling the first control valve and the second control valve.

In some embodiments, when the hydraulic axis is configured so that the first control valve permits hydraulic fluid to flow to the main accumulator and the second control valve is closed, the hydraulic axis operates in the first operating mode. In addition, when the hydraulic axis is configured so that the first control valve isolates the main accumulator from the first line and the second control valve is open, the hydraulic axis operates in the second mode.

In some embodiments, the energy storage accumulator is configured to store a variable amount of energy during each actuation cycle of the actuator.

In some embodiments, an amount of energy stored in the energy storage accumulator is varied in correspondence with variations of load applied to the rod.

In some embodiments, the hydraulic axis includes a charge pump that is driven by a second electric motor. The second motor has variable speed, and the charge pump is configured to control the pressure of hydraulic fluid stored in the energy storage accumulator.

In some embodiments, when the hydraulic axis is in the first operating mode, the hydraulic axis is configured to actuate the actuator via the hydraulic circuit in which hydraulic fluid in the hydraulic circuit is driven by the main pump, excess hydraulic fluid from the actuator is stored at low pressure in the main accumulator, and the energy storage accumulator is isolated from the hydraulic circuit. In addition, when the hydraulic axis is in the second operating mode, the hydraulic axis is configured to actuate the actuator via the hydraulic circuit in which hydraulic fluid in the hydraulic circuit is driven by the main pump, the main accumulator is isolated from the hydraulic circuit, and excess hydraulic fluid from the actuator is stored at high pressure in the energy storage accumulator.

In some embodiments, the main accumulator is a low pressure accumulator configured to operate at pressures corresponding to pressures associated with a low pressure side of the hydraulic circuit, and the energy storage accumulator is a high pressure accumulator configured to operate at pressures corresponding to pressures associated with a high pressure side of the hydraulic circuit.

In some embodiments, the actuator is a differential area actuator having a single rod.

In some embodiments, the hydraulic axis is free of vents and hydraulic fluid reservoirs.

In some embodiments, when the hydraulic axis is in the second operating mode and hydraulic fluid is stored under pressure in the energy storage accumulator, a pressure drop across the pressure connections of the main pump is reduced.

In some embodiments, the main accumulator is configured to store hydraulic fluid under a first pressure, and the energy storage accumulator is configured to selectively store fluid under a second pressure that is higher than the first pressure.

In some embodiments, the energy storage accumulator configured to release the stored fluid at the second pressure during a movement of the rod.

In some aspects, a method of providing energy storage in a closed-hydraulic circuit and reservoir-free hydraulic system is provided. The hydraulic system includes an electric motor, and an actuator. The actuator includes a cylinder, a piston disposed in the cylinder that segregates an interior space of the cylinder into two chambers, and a rod having a first end that is connected to the piston, and a second end that is configured to be connected to a load. The hydraulic system includes a bidirectional hydraulic main pump driven by the electric motor to pump hydraulic fluid through the hydraulic circuit. Pressure connections of the main pump are connected via a first line and a second line to the respective chambers of the actuator such that the rod is configured to extend and retract depending on a direction of flow of the hydraulic fluid through the main pump. The hydraulic system includes a main accumulator connected to the first line via a third line, and a first control valve disposed in the third line between the first line and the main accumulator. The hydraulic system includes an energy storage accumulator connected to the first line via a fourth line, and a second control valve disposed in the fourth line between the first line and the energy storage accumulator. In addition, the hydraulic system includes a charge pump connected to the second line. The method includes the following method step: Transferring oil from the main accumulator to the energy storage accumulator via the charge pump.

In some embodiments, the hydraulic system is switchable between a first operating mode that is free of energy storage in the energy storage accumulator, and a second operating mode in which energy is stored in the energy storage accumulator.

In some embodiments, the hydraulic system is switched between the first operating mode and the second operating mode by controlling the first control valve and the second control valve.

In some embodiments, when the hydraulic system is configured so that the first control valve permits hydraulic fluid to flow to the main accumulator and the second control valve is closed, the hydraulic system operates in the first operating mode, and when the hydraulic system is configured so that the first control valve isolates the main accumulator from the first line and the second control valve is open, the hydraulic system operates in the second mode.

In some embodiments, the energy storage accumulator is configured to store a variable amount of energy during each actuation cycle of the actuator.

In some embodiments, an amount of energy stored in the energy storage accumulator is varied in correspondence with variations of load applied to the rod.

DETAILED DESCRIPTION

Figure 1:
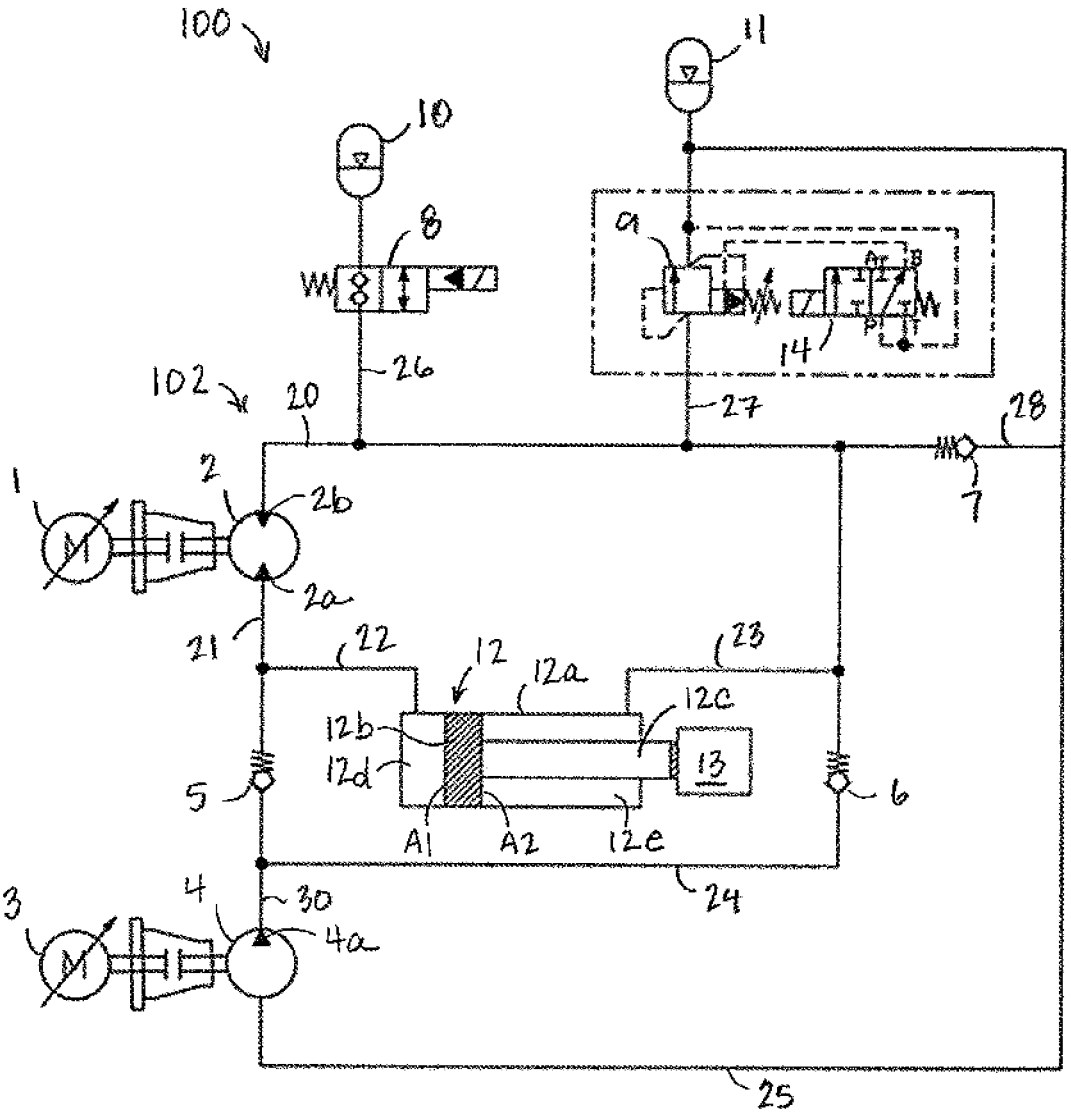
FIG. 1 is a schematic hydraulic circuit diagram illustrating the hydraulic axis.

Referring to FIG. 1, a self-contained hydraulic axis 100 is a compact and powerful driver for moving a load 13, and may be employed, for example, in industrial machines such as presses, bending machines, plastic machines, etc. The hydraulic axis 100 includes a variable speed electric motor referred to as the prime mover 1. The prime mover 1 controls the speed and force applied to the load 13 via an oil filled hydraulic gear system employing a mechanical advantage and rotary to linear motion conversion. More specifically, the prime mover 1 drives a main hydraulic pump 2, which in turn supplies hydraulic fluid to a hydraulic linear actuator 12 via a hydraulic circuit 102. The main hydraulic pump 2 has a fixed displacement volume per revolution, and the actuator 12 has a linear displacement per volumetric input. In the hydraulic circuit 102, the hydraulic fluid volume is closed without an atmospherically vented reservoir. To account for the differential volumes of actuator 12, the hydraulic axis 100 includes a main accumulator 11 that stores excess hydraulic fluid during cycling of the actuator 12. In addition, the hydraulic axis 100 includes an energy storage accumulator 10 that may be used to supplement the prime mover 1 during high power demands and reduce power peaks during load cycles. The energy storage features of the hydraulic axis 100 will be discussed below along with the details of the hydraulic circuit 102.

The actuator 12 is a linear hydraulic cylinder that includes a cylinder 12*a*, a piston 12*b* disposed in the cylinder 12*a*, and a single-end rod 12*c* that is connected to the piston 12*b* and provides a mechanical connection between the piston 12*b* and the load 13. The piston 12*b* is sealed with respect to an inner surface of the cylinder 12*a* and segregates an interior space of the cylinder 12*a* into two sealed chambers, e.g., a piston-side chamber 12*d* and an annular rod-side chamber 12*e*. The piston 12*b* is movable between an advanced position (not shown) and a retracted position (shown) by changing the relative pressures within the piston-side chamber 12*d* and the rod-side chamber 12*e*. The movement of the piston 12*b* to the advanced position provides a working stroke of the hydraulic axis 100. Hereafter, references to "actuator extension" correspond to a state of the actuator 12 in which the piston 12*b* is moving toward, or is in, the advanced position, and references to "actuator retraction" corresponds to a state of the actuator 12 in which the piston 12*b* is moving toward, or is in, the retracted position. References to an "actuator cycle" refer to a movement of the piston from a reference position to a fully extended position, then to a fully retracted position and then back to the reference position.

Figure 2:
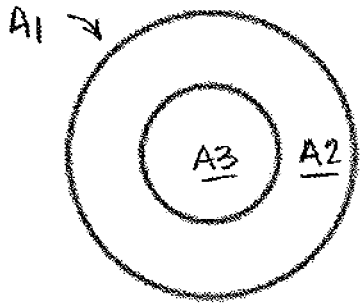
FIG. 2 is an illustration of the load-bearing areas defined by the actuator cylinder, where area A1 is the area of the piston on the piston-side of the cylinder, A2 is the area of the piston on the rod-side of the cylinder, A3 is the area of the rod, and A2=A1−A3.

Referring to FIG. 2, the actuator 12 is a differential area, double acting cylinder. In particular, the piston area A1, which corresponds to the area over which pressure is applied to the piston 12*b*, and the annular area A2, which corresponds to the area over which pressure is applied to the opposed side of the piston 12*b* reduced by the area A3 of the rod 12*c*, are not equal. With equal hydraulic fluid delivery to either the piston-side or rod-side chambers 12*d*, 12*e*, the actuator 12 will move faster when retracting due to a reduced volume capacity. With equal pressure at the piston-side and rod-side chambers 12*d*, 12*e*, the actuator 12 can exert more force when extending because of piston area A1 associated with the piston-side chamber 12*d* is greater than the annular area A2 associated with the rod-side chamber 12*e*. If equal pressure is applied to both chambers 12*d*, 12*e*, and assuming the load 13 is not large enough to offset the differential force, the actuator 12 will extend because of the higher resulting force on the piston-side chamber 12*d*.

When using the actuator 12 in the closed hydraulic circuit 102, it is necessary to store the differential volume $V_D$ of hydraulic fluid resulting from the motion of the actuator 12. The differential volume $V_D$ of the hydraulic fluid in the actuator 12 is a function of the differential areas A1, A2 by which the hydraulic fluid is moved during extension and retraction of the actuator 12. When the actuator 12 is extended, the hydraulic fluid volume $V_{EXT}$ in the cylinder is equal to the area A1*actuator stroke. When the actuator 12 is retracted, the volume $V_{RET}$ is equal to the area A2*actuator stroke. The differential volume $V_D$ corresponds to the difference between the volume $V_{EXT}$ and the volume $V_{RET}$, and thus is equal to the rod volume $V_{ROD}$, which, in turn, is equal to A3*actuator stroke.

Referring again to FIG. 1, the main hydraulic pump 2 is connected at its two pressure connections 2*a*, 2*b* to the hydraulic pressure line system which forms the closed hydraulic circuit 102. The first pressure connection 2*a* is connected to the piston-side chamber 12*d* of the actuator 12 via a lines 21 and 22, and the second pressure connection 2*b* is connected to the rod-side chamber 12*e* of the actuator 12 via lines 20 and 23.

The circuit 102 includes a main accumulator 11, which is a low pressure, gas charged, expansion tank that is sized to store excess hydraulic fluid volume from the actuator 12. The main accumulator 11 is connected to line 20 via a first branch line 27 which also includes a relief valve 9. The relief valve 9 is an infinite position valve whose position (e.g., pressure threshold setting) is determined by a governor 14. During normal operation of the circuit 102 (e.g., operation of the circuit without using the energy storage feature), the pressure threshold of the governor 14 is set relatively low, allowing excess hydraulic fluid, compression/decompression volume and thermal expansion or contraction volume to be stored in the main accumulator 11. The hydraulic fluid of the circuit 102 enters the main accumulator 11 through the relief valve 9 via lines 22, 21, 20 and 27 during actuator retraction and reenters the circuit 102 during actuator extension either through a charge pump 4 via line 25 or through an anti-cavitation check valve 7 via lines 25 and 28.

The charge pump 4 is unidirectional and is driven by a variable speed motor 3. The charge pump 4 receives hydraulic fluid from the main accumulator 11 via low pressure line 25, and discharges hydraulic fluid to the first pressure connection 2*a* of the main hydraulic pump 2 via lines 30 and 21. Fluid flow from the first pressure connection 2*a* toward the charge pump fluid outlet 4*a* is prevented via a first check valve 5 disposed in line 30. In addition, fluid flow from the second pressure connection 2*b* toward the charge pump fluid outlet 4*a* is prevented via a second check valve 6 disposed in line 24.

In addition to the main accumulator 11, the circuit 102 includes the energy storage accumulator 10 configured to store energy during the reduced load parts of the cycle. The energy storage accumulator 10 is a gas charged accumulator that is connected to line 20 of the circuit 102 via a second branch line 26. A control valve 8 is disposed in the second branch line 26 between the energy storage accumulator 10 and line 20. The control valve 8 is a two-way solenoid valve that is normally closed.

Lines 20, 21, 22, 23, 26 and 27 are disposed on the high pressure side of the hydraulic circuit 102. Lines 24 and 30 are disposed on a medium pressure portion of the circuit 102. Lines 25 and 28 are disposed on the low pressure side of the hydraulic circuit 102.

The hydraulic axis 100 can be employed in a first operating mode in which the hydraulic axis 100 is operated conventionally and the energy storage accumulator 10 is isolated, and in a second operating mode in which the hydraulic axis 100 is operated in an energy storage mode in which the main accumulator is isolated and the energy storage accumulator is activated. The hydraulic axis 100 can be switched between the first operating mode and the second operating mode during operation, permitting energy to be stored in the system as appropriate.

By operating the hydraulic axis 100 in the second operating mode, e.g., the energy storage mode, it is possible to store energy during retraction of the actuator. The stored energy can then be used to reduce power peaks during actuator extension, thereby supplementing the prime mover power during actuator extension. This can be advantageous, for example, in applications in which the load 13 requires high energy only during actuator extension, and minimal energy during actuator retraction.

During operation of the hydraulic axis 100 in the second operating mode, the control valve 8 and the relief valve 9 are energized during actuator 12 movement. As a result, the normally closed control valve 8 is opened, allowing flow of hydraulic fluid to the energy storage accumulator 10. At the same time, the pressure threshold of the relief valve 9, controlled by the governor 14, is set relatively high, whereby the main accumulator 11 is isolated from the circuit 102. During actuator retraction (e.g., the reduced load portion of the actuator cycle), hydraulic fluid flows from piston-side chamber 12*d* to the rod-side chamber 12*e*, via lines 22, 21, the main hydraulic pump 2, and lines 20 and 23. The main hydraulic pump 2 will ingest the volume $V_{EXT}$ of hydraulic fluid from the actuator 12 corresponding to the area A1. The pressure in the piston-side chamber 12*d* drops to the pressure of the energy storage accumulator 10, the initial pressure having been pre-set by the charge pump 4. The rod-side chamber 12*e* of the actuator 12, corresponding to area A2, will accept a portion of this hydraulic fluid, while the remaining volume, corresponding to the differential volume $V_D$, will be stored in the energy storage accumulator 10.

The differential volume $V_D$ is pushed into the energy storage accumulator 10 under pressure. The pressure at which the hydraulic fluid is stored within the energy storage accumulator 10 determines the amount of energy available to the hydraulic circuit 102. Because of the physical characteristics of the system, the pressure $P_{A2}$ on area A2 is proportional to the pressure $P_{A1}$ at area A1:

$$P_{A2}=P_{A1}*A1/A2-F13/A1$$

The pressure ratio is directly related to the area ratio less force F13 applied by the load 13.

It is possible to vary the amount of energy stored in the energy storage accumulator 10 during each actuator cycle.

Through this technique, energy storage capacity can be optimized. The amount of energy stored in the energy storage accumulator 10 is a product of the hydraulic fluid volume displaced and the pressure at which the volume is displaced. The volume exchanged, e.g., the differential volume $V_D$, is fixed at A3*stroke, assuming a full stroke of the piston 12*b* and rod 12*c* is made. The pressure at which the differential volume $V_D$ is displaced depends on the pressure of the energy storage accumulator 10 when the actuator 12 is fully extended. The pressure of the energy storage accumulator 10 also depends on the gas pre-charge pressure and the initial volume of hydraulic fluid in the energy storage accumulator 10 when the actuator 12 is fully extended. This initial volume, with the actuator 12 extended, can be raised by transferring hydraulic fluid from the main accumulator 11 to the energy storage accumulator 10. In the illustrated embodiment, this is achieved via the charge pump 4 via lines 25, 30, 21, 20 and 26. As the pressure setting of the charge pump 4 is raised, during the retract phase hydraulic fluid flow through the first check valves 5 will increase the pressure on actuator area A1. To maintain net force, hydraulic fluid will be diverted from the piston-side chamber 12*d* to the rod-side chamber 12*e* via the main pump 2. This will raise the pressure at A2, which will in turn raise the preset pressure of the energy storage accumulator 10 via valve 8. The preset pressure can be lowered by reducing the pressure set point of the charge pump 4. Subsequent system leakage causes the pressure in the energy storage accumulator 10 to be reduced. The charge pump 4 can be adjusted while operating, and the resulting hydraulic fluid exchange (filling or emptying) will happen during the stroke of the actuator 12. Depending on the cylinder stroke frequency, the hydraulic fluid may also exchange incrementally in several stroke cycles. Thus the amount of energy stored in the energy storage accumulator 10 can be changed as variations in load 13 occur.

The preset pressure of the energy storage accumulator 10 can be increased by increasing the pressure set point of the charge pump 4. Subsequent oil addition to the circuit from the charge pump 4 causes the pressure in the energy storage accumulator 10 to be increased.

During extension of the actuator 12, work is performed by the hydraulic axis 100 and hydraulic fluid flows from rod-side chamber 12*e* to the piston-side chamber 12*d*. The extension portion of the actuator cycle corresponds to an increased load portion of the actuator cycle. Since the rod-side chamber 12*e* corresponding to area A2 is smaller than the piston-side chamber 12*d* corresponding to the area A1, more hydraulic fluid is required to fill the piston-side chamber 12*d* than is available from the rod-side chamber 12*e*. At this time, pressurized hydraulic fluid from the energy storage accumulator 10 is used to fill the piston-side chamber 12*d*, reducing the pressure drop across the two pressure connections 2*a*, 2*b* of the main hydraulic pump 2. This, in turn, reduces the torque required to turn the main hydraulic pump 2, permitting the pump 2 to operate at a lower power for a given speed.

The energy stored in the energy storing accumulator 10 is connected to the 2*b* port of the pump 2, allowing the release of the stored energy to be controlled by the prime mover 1.

In applications where the load 13 varies over time, it may be desirable to correspondingly vary the amount of energy stored in the energy storage accumulator 10. Since the energy stored in the energy storage accumulator 10 corresponds to the area under a curve representing the hydraulic fluid pressure versus hydraulic fluid volume within the energy storage accumulator 10, for small changes in pressure it can be assumed that the curve is linear. The volume of hydraulic fluid added to the energy storage accumulator 10 corresponds to the differential volume $V_D$, or area A3*stroke. If pressure is increased, the amount of energy stored is linearly increased. In the circuit 102, the charge pump 4 can be used to raise the hydraulic fluid pressure at the check valve 5, the main pump 2 and the energy storage accumulator 10. Thus, the circuit 102 provides the ability to change the amount of energy stored in accumulator 10 by varying the charge pressure from charge pump 4.

An exemplary application in which load varies over time may include a load 13 in the form of a fluid pump that is used to pump a fluid into a tank (not shown). Initially, when the tank is empty there is no load at the fluid pump. At this initial stage, the hydraulic axis 100 can be operated without energy storage. That is, the relief valve 9 may be set to a low pressure point to permit hydraulic fluid to be stored in the main accumulator 11, while the control valve 8 is closed whereby the energy storage accumulator 10 is isolated from the circuit 102. As the tank fills, the fluid pump experiences load, whereby it becomes advantageous to have stored energy available. At this time, the relief valve 9 is set to a high pressure point to isolate the main accumulator from the circuit 102, and the control valve 8 is opened. In addition, the charge pump is used to direct fluid to the energy storage accumulator 10 and store it there under pressure, where it can be used to equalize pressure at the pressure connections 2*a*, 2*b* of the main pump, reducing torque and increasing available power.

The energy storage feature can be disabled when there is no load in either direction. This is achieved by de-energizing both the control valve 8 and the governor 14 of the relief valve 9. As a result, the control valve 8 is returned to the normally closed state, preventing flow of hydraulic fluid to the energy storage accumulator 10. At the same time, the pressure threshold of the relief valve 9 is set relatively low, allowing flow of hydraulic fluid through the relief valve 9 to the main accumulator 11. With both the control valve 8 and the governor 14 de-energized, the system will not store energy.

In some embodiments, the electric motors 1, 3 and valves 8 and 9/14 are controlled by a general purpose programmable controller (not shown) such as a programmable logic controller (PLC). The PLC may include input modules or points, a central processing unit (CPU) and output modules or points. The PLC receives information from connected input devices and sensors, processes the received data, and triggers required outputs as per its pre-programmed instructions. Instructions carried out by the PLC may be provided by a programming device or stored in a non-volatile PLC memory.

Selective illustrative embodiments of the hydraulic axis are described above in some detail. It should be understood that only structures considered necessary for clarifying the hydraulic axis have been described herein. Other conventional structures, and those of ancillary and auxiliary components of the hydraulic axis, are assumed to be known and understood by those skilled in the art. Moreover, while a working example of the hydraulic axis has been described above, the hydraulic axis is not limited to the working example described above, but various design alterations may be carried out without departing from the hydraulic axis as set forth in the claims.

We claim:

1. A closed hydraulic circuit including a hydraulic axis, the hydraulic axis comprising:

an electric motor;

an actuator comprising a cylinder, a piston disposed in the cylinder that segregates an interior space of the cylinder into two chambers, and a rod having a first end that is connected to the piston, and a second end that is configured to be connected to a load;

a bidirectional hydraulic main pump driven by the electric motor to pump hydraulic fluid through the hydraulic circuit, pressure connections of the main pump connected via a first line and a second line to the respective chambers of the actuator such that the rod is configured to extend and retract depending on a direction of flow of the hydraulic fluid through the main pump;

a main accumulator connected to the first line via a third line;

a first control valve disposed in the third line between the first line and the main accumulator;

an energy storage accumulator connected to the first line via a fourth line; and a second control valve disposed in the fourth line between the first line and the energy storage accumulator, wherein the hydraulic axis is switchable between a first operating mode that is free of energy storage in the energy storage accumulator, and a second operating mode in which energy is stored in the energy storage accumulator.

2. The hydraulic axis of claim 1, wherein the hydraulic axis is switched between the first operating mode and the second operating mode by controlling the first control valve and the second control valve.

3. The hydraulic axis of claim 2, wherein in the first operating mode, the hydraulic axis is configured so that the first control valve permits hydraulic fluid to flow to the main accumulator and the second control valve is closed, and in the second operating mode, the hydraulic axis is configured so that the first control valve prevents fluid flow between the main accumulator and the first line and the second control valve is open.

4. The hydraulic axis of claim 1, wherein the energy storage accumulator is configured to store a variable amount of energy during each actuation cycle of the actuator.

5. The hydraulic axis of claim 1, wherein an amount of energy stored in the energy storage accumulator is varied in correspondence with variations of load applied to the rod.

6. The hydraulic axis of claim 1, comprising a charge pump that is driven by a second electric motor, the second motor having variable speed, the charge pump configured to control the pressure of hydraulic fluid stored in the enemy storage accumulator.

7. The hydraulic axis of claim 6, wherein the amount of energy stored in the energy storage accumulator during an actuation cycle of the actuator varies based on a charge pressure that is controlled by the charge pump.

8. The hydraulic axis of claim 1, wherein in the first operating mode, the hydraulic axis is configured to actuate the actuator via the hydraulic circuit in which hydraulic fluid in the hydraulic circuit is driven by the main pump, excess hydraulic fluid from the actuator is stored at low pressure in the main accumulator, and the energy storage accumulator is isolated from the hydraulic circuit, and in the second operating mode, the hydraulic axis is configured to actuate the actuator via the hydraulic circuit in which hydraulic fluid in the hydraulic circuit is driven by the main pump, fluid flow to the main accumulator is prevented, and excess hydraulic fluid from the actuator is stored at high pressure in the energy storage accumulator.

9. The hydraulic axis of claim 1, wherein the main accumulator is a low pressure accumulator configured to operate at pressures corresponding to pressures associated with a low pressure side of the hydraulic circuit, and the energy storage accumulator is a high pressure accumulator configured to operate at pressures corresponding to pressures associated with a high pressure side of the hydraulic circuit.

10. The hydraulic axis of claim 1, wherein the actuator is a differential area actuator having a single rod.

11. The hydraulic axis of claim 1, wherein the hydraulic axis is free of vents and hydraulic fluid reservoirs.

12. The hydraulic axis of claim 1, wherein when the hydraulic axis is in the second operating mode and hydraulic fluid is stored under pressure in the energy storage accumulator, a pressure drop across the pressure connections of the main pump is reduced.

13. The hydraulic axis of claim 1, wherein the main accumulator is configured to store hydraulic fluid under a first pressure, and the energy storage accumulator is configured to selectively store fluid under a second pressure that is higher than the first pressure.

14. The hydraulic axis of claim 13, wherein the energy storage accumulator configured to release the stored fluid at the second pressure during a movement of the rod.

15. The hydraulic axis of claim 1, wherein the amount of energy stored in the energy storage accumulator is controlled independently of the load applied to the system.

16. The hydraulic axis of claim 1, wherein the amount of energy available to the hydraulic circuit is optimized by varying the amount of energy stored in the energy storage accumulator.

17. A method of providing energy storage in a hydraulic system, the hydraulic system comprising:

a closed hydraulic circuit;

an electric motor;

an actuator comprising a cylinder, a piston disposed in the cylinder that segregates an interior space of the cylinder into two chambers, and a rod having a first end that is connected to the piston, and a second end that is configured to be connected to a load;

a bidirectional hydraulic main pump driven by the electric motor to pump hydraulic fluid through the hydraulic circuit, pressure connections of the main pump connected via a first line and a second line to the respective chambers of the actuator such that the rod is configured to extend and retract depending on a direction of flow of the hydraulic fluid through the main pump;

a main accumulator connected to the first line via a third line;

a first control valve disposed in the third line between the first line and the main accumulator;

an energy storage accumulator connected to the first line via a fourth line;

a second control valve disposed in the fourth line between the first line and the energy storage accumulator; and a charge pump connected to the second line, the method comprising transferring oil from the main accumulator to the energy storage accumulator via the charge pump.

18. The method of claim 17, wherein the hydraulic system is switchable between a first operating mode that is free of energy storage in the energy storage accumulator, and a second operating mode in which energy is stored in the energy storage accumulator.

19. The method of claim 18, wherein the hydraulic system is switched between the first operating mode and the second operating mode by controlling the first control valve and the second control valve.

20. The method of claim 18, wherein in the first operating mode, the hydraulic axis is configured so that the first control valve permits hydraulic fluid to flow to the main accumulator and the second control valve is closed, and in the second operating mode, the hydraulic axis is configured so that the first control valve prevents fluid flow between the main accumulator and the first line and the second control valve is open.

21. The method of claim 17, wherein the energy storage accumulator is configured to store a variable amount of energy during each actuation cycle of the actuator.

22. The method of claim 17, wherein an amount of energy stored in the energy storage accumulator is varied in correspondence with variations of load applied to the rod.

* * * * *